US005138718A

United States Patent [19]

Willard

[11] Patent Number: 5,138,718

[45] Date of Patent: Aug. 18, 1992

[54] SKI GLOVE

[76] Inventor: Ellery T. Willard, 408 S. William St., Johnstown, N.Y. 12095

[21] Appl. No.: 620,220

[22] Filed: Nov. 30, 1990

[51] Int. Cl.[5] ..... A41D 19/00

[52] U.S. Cl. ..... 2/159; 2/163; 2/164

[58] Field of Search ..... 2/159, 158, 161 A, 161 R, 2/163, 169, 16, 164

[56] References Cited

U.S. PATENT DOCUMENTS 1,404,398 1/1922 Lipson ..... 2/158
1,885,572 11/1932 Wood ..... 2/159 X
2,905,946 9/1959 Goldsmith ..... 2/158
4,742,580 5/1988 Phillips, Jr. et al. ..... 2/158

*Primary Examiner*—Werner H. Schroeder
*Assistant Examiner*—Sara M. Current
*Attorney, Agent, or Firm*—Schmeiser, Morelle & Watts

[57] ABSTRACT

An insulated glove that has an increased area heat pocket and reduced length long finger portions. Each long finger portion is adapted to loosely fit each finger and thereby allow heated air to flow from the heat pocket outwardly to the fingertips. In the preferred embodiment, an oversized outer glove shell is used to enable the loose fit of the long finger portions.

4 Claims, 1 Drawing Sheet

SKI GLOVE

FIELD OF THE INVENTION

The invention is in the field of hand coverings. More specifically, the invention is a type of glove that provides the finger heating capabilities of a mitten. The glove is normally used in pairs wherein each glove has reduced length digit portions and is adapted to enable warm air to circulate throughout the glove.

BACKGROUND OF THE INVENTION

Mittens and gloves are two well-known types of hand coverings. A mitten is designed to enclose almost the entire hand within a large, bag-shaped primary structure. Most mittens also include an ancillary portion to receive the wearer's thumb. As is well known, a glove is different from a mitten because it is shaped to exactly fit the wearer's hand and includes separate digit portions that are sized and shaped to receive each of the wearer's fingers. Beyond the obvious physical differences, mittens and gloves each have their own distinct advantages and disadvantages.

The design of a mitten provides excellent heating ability due to the use of a primary body portion to form a large heat-retaining inner pocket or cavity. Furthermore, by loosely enclosing most of the hand within the single heat pocket, the heat generated by the hand is dispersed throughout the pocket and therefore contacts most of the wearer's hand. In this manner, the large quantity of heat given off by the palm and back portions of the hand is also used to warm the fingers. This enables a mitten to be capable of keeping a wearer's hand warm even when the ambient temperature is extremely low.

The primary disadvantage of a mitten lies in its almost total elimination of the hand's manual dexterity. The wearer can at best grab an object between the thumb and finger portions of the mitten in a manner similar to a bifurcated claw. The use of a single primary pocket does not allow any of the hand's long digits to be independently wrapped about an object. Therefore, a mitten can only be used when manual dexterity is not required.

The advantage of a glove is that it allows the wearer a manual dexterity that is similar to that of a bare hand. The fingers can be moved independently, thereby allowing even complex manual manipulations to be accomplished.

It is well known that gloves cannot provide adequate heating of a wearer's hands when extremely cold temperatures are encountered. A glove's heating ability is directly related to the size of the primary heat pocket and the thickness of the insulating layer sandwiched between the glove's inner liner and outer shell. To compensate for a glove's smaller heat pocket, many manufacturer's increase the thickness of the insulating layer. Unfortunately, any increase in insulation thickness reduces the dexterity allowable when the glove is worn. To maintain some degree of manual dexterity in low temperature applications, it follows that the heating ability of a glove must be partially sacrificed The heating ability of a glove is further diminished by a lack of internal air circulation. In an insulated glove, the interior liner is in tight contact with the hand and especially with the fingers. When the wearer inserts his or her hand into the glove, the liner is pushed outwardly and this causes a compression of the insulation between the liner and the less flexible outer shell. As a result, the liner and insulation form a tight seal around the fingers. This effect substantially isolates the fingers from the primary heat packet formed by the glove around the palm and back portions of the hand. Due to the lack of air flow to the fingers, the only method of maintaining the temperature of the fingers is by the circulation of blood within the fingers. During cold weather, a glove wearer's fingers can easily become cold thereby producing the general feeling of having cold hands. This is an uncomfortable situation that the wearer will most often attempt to overcome by placing his or her gloved hands within the outer pockets of a coat.

There are situations when the above noted glove disadvantages are extremely noticable. Many cold weather sports are practiced in frigid weather and at the same time require a significant measure of manual dexterity from the user. Skiing is one such example. This sport is practiced on mountain slopes in which below zero temperatures and strong winds are frequently encountered. A skier is required to constantly hold and maneuver the ski poles while proceeding down the hill. In addition, should the skier fall, the skier may he required to manipulate portions of the ski bindings in order to replace the skis on the boots. Even such mundane tasks as the zipping or buttoning of a coat can require a degree of physical dexterity that is unavailable when mittens are worn. Therefore, a skier will often have to endure a glove's inadequate heating of the fingers so that a sufficient level of manual dexterity is available.

SUMMARY OF THE INVENTION

The invention is a combination glove and mitten that is capable of keeping a wearer's hand warm in a manner similar to a mitten while still affording a large degree of manual dexterity. In the preferred embodiment, the glove includes a soft, flexible inner liner and a durable, wear-resistant outer shell. Sandwiched between the liner and shell is a layer of insulating material such as polyester batting or THINSULATE brand of highly insulating fibers.

A glove made in accordance with the invention comprises an oversized body portion, a thumb portion and four reduced-length finger receiving portions. The finger portions are located at an end of the body portion in the conventional manner. A thumb receiving portion is also attached to the main body portion in the conventional manner.

Each of the reduced-length finger portions is sized to approximately cover the wearer's finger from the fingertip to the first knuckle joint nearest the base of the finger. The finger portions are designed to loosely fit over the fingers so that warm air from the interior of the glove's main body (primary heat pocket) can travel to each of the wearer's fingertips. In the preferred embodiment, the loose fit of the finger portions creates spaces between each of the long fingers and the liner through which the warm air can travel. In this manner, the fingers are kept as warm as the rest of the hand in substantially the same manner as provided by a mitten. The bendable glove-like finger portions provide to the wearer a large degree of manual dexterity.

DETAILED DESCRIPTION OF THE DRAWINGS

Figures 1, 2, 3:
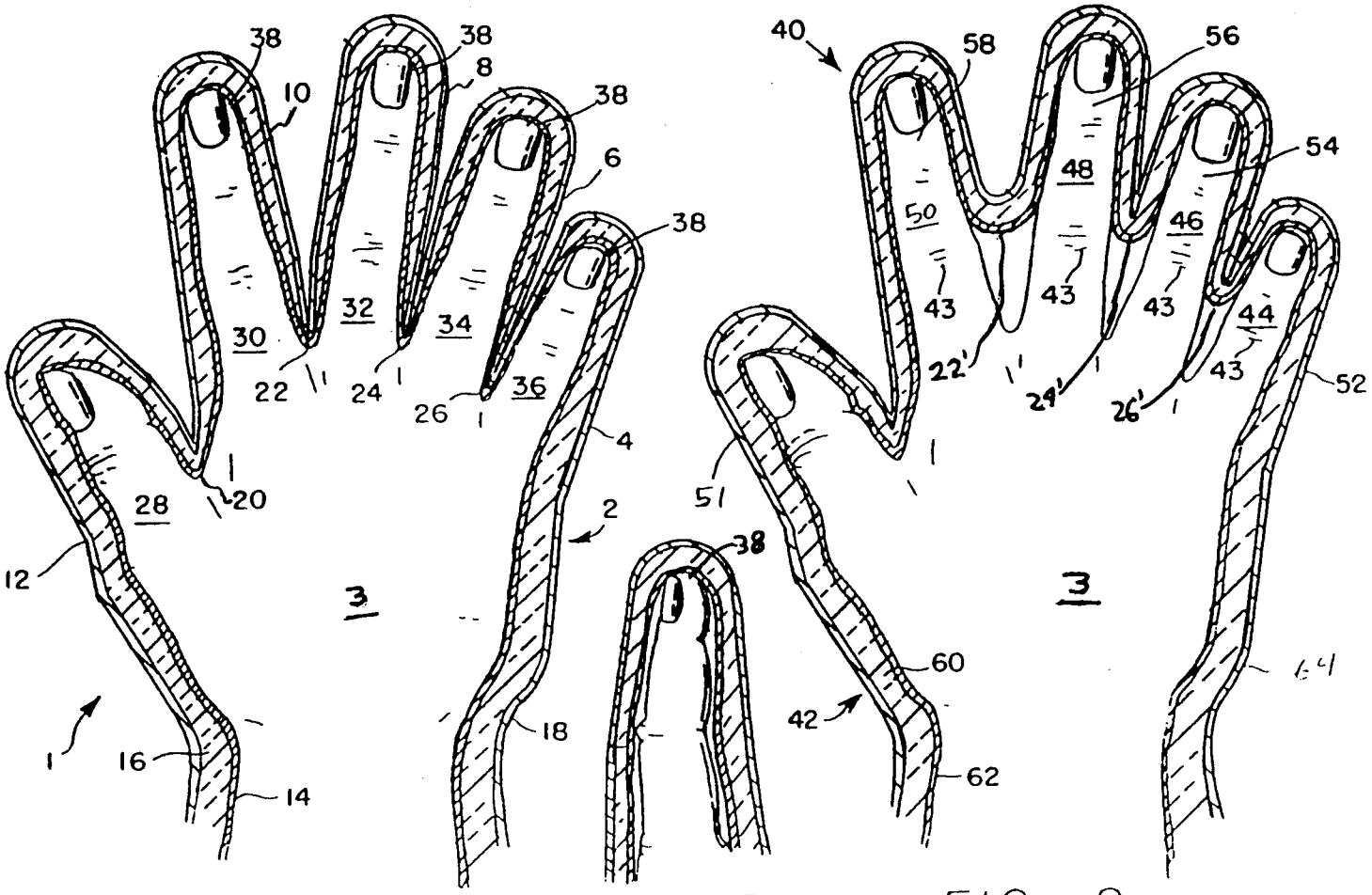
FIG. 1 PRIOR ART
FIG. 1 shows a top cross-sectional view of a prior art glove placed on a human hand.
FIG. 2 shows a top cross-sectional view of a glove in accordance with the invention with the glove placed on a human hand.
FIG. 3 is an elevational cross-sectional view of one of the finger portions of the glove shown in FIG. 2.

Referring now to the drawings in greater detail, wherein like reference characters refer to like parts throughout the several figures, there is shown by the numeral 1 a prior art glove. The glove is shown positioned on a human hand 3.

As seen in FIG. 1, the prior art glove is composed of a main body portion 2 (extending from the wrist to the base of the fingers), four long finger portions 4, 6, 8 and 10 and a thumb portion 12. The glove is constructed from an inner liner 14, a layer of insulation 16 and an outer shell 18. It should be noted that at the crevice points 20, 22, 24 and 26 (located between the finger portions), the insulation is greatly compressed. The compression of the insulation that is depicted in the figure is due to the normal close spacing of a person's fingers. This compression causes the glove to form a seal around the base of each finger 28, 30, 32, 34 and 36. This sealing action effectively prevents any warm air located within the glove s body portion 2 from traveling outwardly to the wearer's fingertips 38. The insulation laYer being compressed between the liner and the shell also reduces the loft of the insulation and thereby lessens its heat retaining ability. In addition, the compressed insulation is often responsible for an improper or uncomfortable glove fit.

FIG. 2 provides a top, cross-sectional view of a glove 40 made in accordance with the invention. A human hand 3 is shown positioned within the glove. The glove has a body portion 42 that has an internal cavity that forms the glove's primary heat pocket. The cavity is sized to contain a major portion of the hand and extends from the wrist up to the first knuckle joint 43 of each long finger 44, 46, 48 and 50. The body portion also extends to the base of the thumb portion 51 of the glove. The glove is shown to have four long finger receiving portions 52, 54, 56 and 58 that are each shorter in length than the similar finger receiving portions of a prior art glove that would be used to fit the same size hand. As done in the prior art, the glove is constructed from an insulating layer 60 that is sandwiched between a liner 62 and an outer shell 64.

Each of the long finger portions of the glove shown in FIG. 2 have a larger outer circumference than those of a prior art glove that would normally be used to fit a hand of the same size. This is accomplished by expanding the size of the outer shell. Preferably, the size of the top, bottom and sidewalls of the outer shell surrounding each finger portion is increased along with an increase in the size of the fouchette (strip between the fingers). For example, a size "large" prior art ski glove may incorporate an index finger portion that is three and three-quarters of an inch in outer circumference when measured in the approximate area that is to surround the knuckle nearest the fingertip. In the instant invention, the same finger portion of the same size glove using the same amount of insulation will have an outer circumference that measures approximately four and one-half inches in the same area.

By making the shell of the finger portions larger than the shell used in a standard insulated glove, the compression of the insulating layer is greatly reduced. This causes the finger portions of the glove to fit very loosely on the fingers. As a result, air can flow between the fingers and the liner portion that surrounds the fingers and in this manner, warm heated air located within the primary heat pocket of the glove can flow outwardly to the fingertips.

The looseness of fit of the liner relative to one of the long fingers is shown in FIG. 3. In this view, an elevational cross-section of one of the finger portions shown in FIG. 2 is depicted. As can be seen, the liner 62 is not biased by the insulating layer to be in continual contact with the finger except in the area at the very tip of the finger.

The invention provides a number of advantages over the prior art. By having the finger portions end at the first knuckle 43 of each long finger, the size of the heat pocket (area within the main body portion 42) of the glove is significantly increased. In the instant invention, the heat pocket is sized to contain the palm of the hand, the back of the hand and the portion of each long finger up to the first knuckle. By increasing the amount of the hand within the main body of the glove, a greater quantity of heat is captured from the surface of the hand and is used to heat the air within the primary heat pocket of the glove. This increases the hand warming capacity of the glove since its heat pocket is only slightly smaller than that of a mitten. This greater volume of heated air in combination with loose fit of the finger portions significantly enhances the ability of the heated air to flow outwardly into the long finger portions of the glove.

Another significant advantage of the invention is in the reduced compression of the insulating layer in the finger crotch regions 22', 24' and 26'. This is a result of moving the crotch portion of the glove outwardly (taking advantage of the normal tapering of a human finger) and by increasing the outer shell diameter. In this manner, the decrease in loft and discomfort of the prior art gloves is avoided. In addition, a seal is not formed around the body of each finger and therefore warm air is allowed to flow from the main body (heat pocket) portion outwardly to the fingertips.

The embodiment of the invention disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention.

I claim:

1. An insulated glove comprising:

a tubular body portion having an opening at a first end that is sized to admit a wearer's hand into an interior cavity within said body portion;

a plurality of long finger portions located at a second end of said body portion wherein each long finger portion is sized and adapted to inwardly receive a long finger of a wearer's hand;

a thumb portion attached to said body portion wherein said thumb portion is sized and adapted to inwardly receive a thumb of a wearer's hand and has an outer tip that is spaced from said first end of said body portion by a first predetermined distance;

said long finger portions having a length wherein each can surround only a forward portion of a long finger of a wearer's hand;

wherein a plurality of said long finger portions have a bottom end that is spaced from said first end of said body portion by a distance that is greater than said first predetermined distance;

wherein said long finger portions are adapted to loosely fit around the fingers of a wearer's hand and thereby allow air to flow from the cavity within the glove's body portion to an interior tip portion of each of the long finger portions; and wherein the glove is constructed from an insulating layer of material sandwiched between an outer shell and an inner liner and wherein said outer shell has an outer circumference in the area of the finger portions that allows the insulating layer around and between the long finger portions to remain in a substantially noncompressed state and thereby allows the long finger portions to loosely fit the fingers of a wearer's hand when a wearer has placed a hand within said glove thereby allowing air to travel from the body portion to the interior tip portions of each of the long finger portions.

2. The glove of claim 1 wherein when a wearer's fingers are located within said glove, continuous air passages are located between said fingers and said linear whereby air can flow from said main body cavity to a wearer's fingertips through said air passages.

3. The glove of claim 1 wherein each of said long finger portions includes a front outer surface, a back outer surface and two outer sidewalls and wherein said sidewalls of said long finger portions have a width that is greater than a width of a long finger of a hand of a wearer.

4. The glove of claim 3 wherein six of said sidewalls of said long finger portions join to form three "V" -shaped spaces between said long finger portions and wherein when said glove is placed on a hand of a wearer, a bottom end of each of said "V"-shaped spaces is located proximate a first knuckle of each of a wearer's long fingers.

* * * * *